US005261486A

United States Patent [19]

Cornette et al.

[11] Patent Number: 5,261,486

[45] Date of Patent: Nov. 16, 1993

[54] METHOD AND APPARATUS FOR GRAVEL PACK WELL COMPLETIONS

[75] Inventors: Holley M. Cornette, Houston; Michael H. Johnson, Spring; Robert K. Bethel, Houston, all of Tex.

[73] Assignee: Atlantic Richfield Company, Los Angeles, Calif.

[21] Appl. No.: 877,924

[22] Filed: May 4, 1992

[51] Int. Cl.[5] ..... E21B 43/04

[52] U.S. Cl. ..... 166/51; 166/74; 166/129; 166/205

[58] Field of Search ..... 166/51, 74, 205, 229, 166/278, 129, 223, 290, 330; 175/392, 394

[56] References Cited

U.S. PATENT DOCUMENTS

| | | | |
|---|---|---|---|
| 2,371,391 | 3/1945 | Haynes | 166/5 |
| 2,513,944 | 7/1950 | Kessler | 166/1 |
| 2,755,862 | 7/1956 | Abendroth et al. | 166/51 |
| 2,942,664 | 6/1960 | Burns | 166/51 |
| 3,153,451 | 10/1964 | Chancellor et al. | 166/51 |
| 3,637,010 | 1/1972 | Maly et al. | 166/51 |
| 3,726,343 | 4/1973 | Davis, Jr. | 166/51 |
| 4,192,375 | 3/1980 | Maly et al. | 166/51 |
| 4,270,608 | 6/1981 | Hendrickson et al. | 166/278 |
| 4,363,366 | 12/1982 | Hilty | 175/314 |
| 4,635,725 | 1/1987 | Burroughs | 166/278 |
| 4,681,163 | 7/1987 | Guidry et al. | 166/278 |
| 4,995,456 | 2/1991 | Cornette et al. | 166/51 |
| 5,036,920 | 8/1991 | Cornette et al. | 166/278 |

OTHER PUBLICATIONS

Petroleum Production Engineering, Oil Field Development, L. C. Uren, 3rd Edition, McGraw-Hill Book Co., N.Y., 1946 pp. 575-588.

U.S. co-pending application Ser. No. 07/668,003, filed Mar. 12, 1991.

*Primary Examiner*—Ramon S. Britts
*Assistant Examiner*—Frank S. Tsay
*Attorney, Agent, or Firm*—Drude Faulconer

[57] ABSTRACT

A method and apparatus for installing a gravel pack well completion wherein flow of fluid in the well can be effectively blocked and excessive hydrostatic pressure can be isolated from the top of a pre-placed column of gravel while an auger-liner assembly is rotated into the gravel. Basically, gravel is first placed within the zone after which a liner is lowered on a workstring and the liner is augered into the pre-placed gravel. A packer cup and by-pass assembly is coupled into the workstring having cup packers which effectively block flow within the well during installation of the liner. The cups are mounted on a rotatably mounted sleeve so that the workstring can be rotated while the cups are expanded against the well casing. The packer cup and by-pass assembly includes a bypass which can be opened after the liner has been placed so that the workstring can easily be withdrawn from the well.

16 Claims, 2 Drawing Sheets

METHOD AND APPARATUS FOR GRAVEL PACK WELL COMPLETIONS

DESCRIPTION

1. Technical Field

The present invention relates to gravel pack well completions and in one of its preferred aspects relates to a method and apparatus for gravel packing a well wherein a particulate material (collectively called "gravel") is first deposited or pre-placed within the well and a fluid-permeable liner assembly is rotated into said pre-placed gravel while excessive hydrostatic pressure is isolated from the top of the pre-placed gravel.

2. Background Art

In completing wells having production or injection zones which lie adjacent incompetent subterranean formations (i.e. formations formed of an unconsolidated matrix such as loose sandstone or the like) or which lie adjacent formations which have been hydraulically-fractured and propped, serious consideration must be given to the problems of sand control. These problems arise when large volumes of sand and/or other particulate material (e.g. backflow of proppants from a hydraulically-fractured formation) dislodge from the formation and become entrained in the produced formation fluids. These particulate materials are highly detrimental to the operation of the well and routinely cause erosion, plugging, etc. of the well equipment which, in turn, leads to high maintenance costs and considerable downtime of the well.

While many techniques have been proposed for controlling sand production in a well, probably the most widely-used is ne which is generically known as "gravel packing". Basically, a gravel pack completion is one wherein a fluid-permeable liner is positioned within the wellbore (open or cased) adjacent the incompetent or fractured zone and is surrounded by aggregate or particulate material (collectively called "gravel"). As known in the art, the gravel particles are sized to block or filter out the formation particulates from the produced fluids while the openings in the liner are sized to block the gravel and removed particulates from flowing into the liner. This two-stage filtration system is commonly known as a "gravel pack".

There are several known techniques for installing a typical gravel pack completion in a wellbore. For example, one such technique involves positioning the fluid-permeable liner in the wellbore and then placing the gravel around the liner to form the gravel pack. Another technique involves placing the gravel in the wellbore first and then driving, rotating, or washing the liner into the gravel to form the gravel pack. For a good discussion of these techniques, see PETROLEUM PRODUCTION ENGINEERING, Oil Field Development, L. C. Uren, Third Edition, McGraw-Hill Book Co., N.Y., 1946, pps. 575–588.

Another technique for forming a gravel pack completion involves first placing the gravel in the wellbore adjacent the zone to be completed and then "augering" a fluid permeable liner into place within the pre-placed gravel; see U.S. Pat. Nos. 2,371,391; 2,513,944; and 5,036,920. In completing wells with this technique, however, it is important and highly desirable to control flow in the well during the rotation and placement of the liner into the pre-placed gravel.

To do this, the downhole well pressure adjacent the pre-placed gravel should be maintained as close as is practical to the pressure in the formation being completed, i.e. "balanced" or preferably slightly "underbalanced". That is, desirably the formation pressure should not exceed the wellbore pressure by more than 200 pounds or so.

If the formation pressure is substantially greater than the hydrostatic pressure in the wellbore (e.g. in excess of about 200 pounds or so), formation fluids will normally flow through the perforations in the casing and into the wellbore thereby displacing the gravel which has been pre-placed into the perforations. This unwanted flow of formation fluids may further disturb the pre-placed gravel in the wellbore, itself.

If the hydrostatic pressure in the well is substantially greater than the formation pressure (e.g. 200–400 pounds), the excess hydrostatic pressure will exert a substantial compressive force onto the pre-placed gravel in the wellbore thereby making the rotation and final placement of the liner into the gravel extremely difficult, if possible at all.

Typically, flow in the wellbore is controlled during the installation of a gravel pack completion by filling the the wellbore above the pre-placed gravel with a liquid having a desired weight. The head of this liquid in the well ideally provides the desired hydrostatic pressure on the pre-placed gravel to "balance" the formation pressure, hence no flow will occur in the well during installation. Where the formation pressures are high, expensive and exotic, heavily-weighted liquids must be used to provide the high hydrostatic pressure required to balance the high formation pressures. Unfortunately, even with careful control, it is not uncommon for at least a portion of these heavy liquids to be lost into the formation during the gravel pack completion. These lost liquids are not only very expensive and add substantially to the completion costs, but more importantly in some instances, they severely damage the formation which, in turn, adversely affect the subsequent production from the formation during its operational life. Further, it not uncommon for gases to migrate from the formation and up through the head of liquid in the well to the surface. This creates an undesirable condition at the wellhead as the liner is lowered on a workstring and rotated into the gravel.

DISCLOSURE OF THE INVENTION

The present invention provides a method and apparatus for installing a gravel pack well completion wherein flow of fluid can be effectively blocked in the well and excessive hydrostatic pressure can be isolated from the top of a pre-placed column of gravel while an auger-liner assembly is rotated into the gravel. Basically, gravel is first placed within the zone after which the gravel pack well tool of the present invention is lowered on a workstring and the liner assembly is augered into the pre-placed gravel by rotating the workstring. A packer cup and by-pass assembly is coupled into the workstring whereby the cup packers on the assembly effectively block flow within the well. Preferably, the cup packers are positioned to face upward so that when the workstring is in an operable position within the well, they will effectively isolate the top of the gravel column from excessive hydrostatic pressures in the well. The cups are mounted on a sleeve which, in turn is rotatably mounted on the workstring so that the workstring can be rotated while the cups are expanded against the well casing.

More specifically, the present invention provides a method of installing a gravel packing completion adjacent a formation in a well wherein a column of gravel is pre-placed in the well adjacent the formation before a fluid permeable liner is lowered on a workstring. The workstring is rotated to rotate the liner into said gravel while blocking the flow in said well during the rotation of said liner. The flow is blocked in a downward direction by at least one upward-facing cup packer on said workstring. After the liner is in place, the cup packer is bypassed so that the workstring can be withdrawn from the well.

The packer cup and by-pass assembly is comprised of a base pipe which is adapted to be coupled into the workstring. A sleeve is rotatably mounted on said base pipe and at least one cup packer is mounted on said sleeve whereby the base pipe can freely rotate with respect to said cup packer even when the one cup packer is expanded by pressure in the well. The packer cup and by-pass assembly includes a valve which is normally in a closed position to block flow by said the cup packer during installation and is responsive to an increase in pressure to move to an open position to allow fluid to bypass the cup packer as the workstring is withdrawn from the well.

In one embodiment, the cup packer is positioned on said sleeve to face upward to prevent downward flow when said workstring is in an operable position within a well and to isolate the pre-placed gravel from excessive hydrostatic pressures in the well. In another embodiment, the cup packer is positioned on said sleeve to face downward to prevent upward flow when said workstring is in an operable position within a well.

The sleeve forms a passage between itself and the base pipe which extends along said base pipe from a point above the cup packer to a point below said the packer. The passage includes an opening in said sleeve above and below said cup packer. A sliding valve is mounted on said sleeve and is normally held in a closed position to block the opening above said cup packer by a means (e.g. shear pin) until it is until subjected to a predetermined pressure.

In another embodiment, the sleeve includes a chamber in which a sliding valve is mounted to block the bypass opening. A pressure-sensitive valve (e.g. rupture disk) closes an opening through said sleeve adjacent one end of the sliding valve. The valve is responsive to a predetermined pressure to open the opening below the sliding valve to the well pressure which, in turn, moves the sliding valve to an open position to allow flow through the bypass opening.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
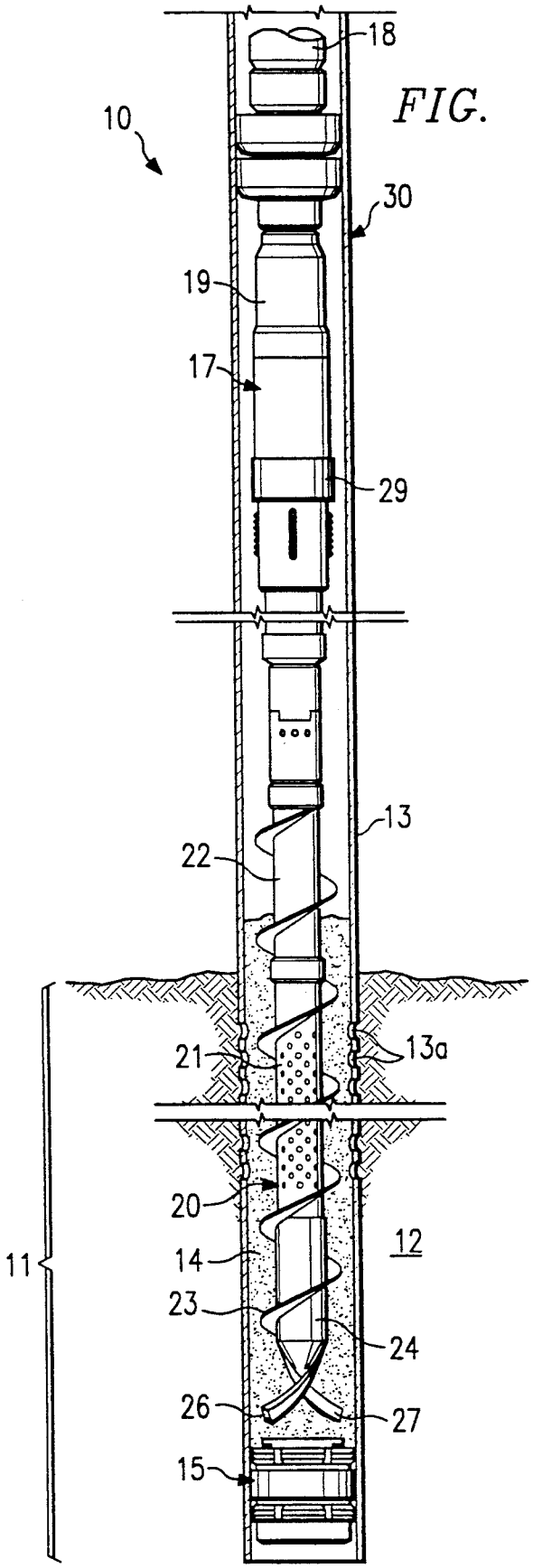
FIG. 1 is an elevational view, partly in section, of a gravel pack completion in accordance with the present invention.

Referring more particularly to the drawings, FIG. 1 illustrates a gravel pack completion in accordance with the present invention as it is being installed in well 10 (e.g. production or injection well). Well 10 has a completion zone 11 therein which lies adjacent to a relatively incompetent formation 12 of the type which is likely to produce sand and/or other particulate material at some time during its operational life. As shown, well 10 has been cased along its length with casing 13 which has been perforated to provide perforations **13*a* adjacent zone 11**. While the present invention is shown and described in relation to completing a zone in a cased, vertical wellbore, it should be understood that the invention can also be used for carrying out completions in open holes as well as in horizontal or deviated wells or to prevent proppant flowback in wells which have been hydraulically-fractured and propped.

In those wells where the wellbore extends past the bottom of completion zone 11, a cement plug, bridge plug or an equivalent-type packer 15 is set in the wellbore at the lower end of zone 11. Sufficient gravel 14 then supplied down the wellbore and onto the top of plug 15 to fill the wellbore through the length of zone 11 which is to be completed. "Gravel" as used herein is intended to include all particulate and/or aggregate materials (e.g. gravel, sand, combinations, etc.) which are used or can be used in gravel pack or fractured completions. As known in the art, the "gravel" particles used in a particular situation are sized so as to block or filter out the particulates which may be produced with the well fluids or which are used to prop open a hydraulically-induced fractures in the formation.

The preset or pre-placed gravel 14 may be introduced into wellbore in any suitable manner, depending upon the actual circumstances involved with a particular completion zone 11. For example, where formation 12 is a relatively low pressured formation, gravel may be flowed down and out of the lower end of a workstring (not shown) which is lowered down the well and positioned above plug 15 or it may be dumped or pumped or bullheaded into the well at the surface and allowed to fall under the influence of gravity. The gravel may be flowed into the wellbore as a substantially dry mixture or as a slurry (mixed with a carrier fluid such as polymer-type, water-based fluid, crude oil, etc.). This type of gravel placement does not require high pressures thereby reducing fluid losses and/or potential damage to the formation. Further, if the situation and formation pressures allow, the gravel may be placed by standard squeeze operations which will insure good filling of perforations **13*a* with the gravel during the placement of the preset gravel 14** or it may be placed in conjunction with a propped, hydraulic fracture fluid.

After the preset or pre-placed gravel 14 is in place adjacent to zone 11, gravel pack well tool 17 is lowered into the wellbore. As illustrated, gravel pack well tool 17 is comprised of an auger-liner assembly 20 which is connected onto the bottom of workstring 18 by means of release sub 19. Auger-liner assembly 20 is comprised of a body formed of a "fluid-permeable liner" 21, which as used herein is meant to be generic and to include any and all types of liners (e.g. screens, slotted pipes, screened pipes, perforated liners, pre-packed screens and/or liners, combinations of same, etc.) which are used or could be used in well completions of this general type. As will be recognized by those skilled in the art, there are presently several known suppliers from whom such "liners" are readily commercially available. The liner may be of a continuous length, as shown, or it may be comprised of a plurality of segments connected by subs or "blanks".

Auger blade 23 is affixed along the outer periphery of auger-liner assembly 20 including nose sub 24 and preferably has basically the same configuration as known earth augers in that it is one or more continuous flightings which extend helically around the periphery of assembly 20 and is secured thereto by any appropriate means, e.g. welding. The auger blade 23 extends sufficiently along the length of gravel pack tool so that the liner will be properly positioned within the preset gravel 14 to form the desired gravel pack completion. If auger-liner assembly 20 is comprised of segments and blanks or if blank tubular sections 22 (one shown in FIG. 1) above auger-screen 20 are also to be positioned within gravel 14, auger blade 23 may also extend about the periphery of such blanks.

Affixed to the lower end of nose sub 24 are two, diametrically-opposed, spirally-extending blades 26, 27 which effectively form a "fish-tail" bit at the leading edge of sub 24. Blades 26, 27 may be independent elements which are welded or otherwised secured to the sub 24 or if dual flights are used to form auger blade 23, then blades 26, 27, respectively, may be the terminals or these flights. As shown in FIG. 1, gravel pack tool 20 also includes a typical packer 29 although it should be recognized that this packer can be eliminated if not needed for a particular application.

In carrying out a gravel pack completion with the gravel pack tool 17, a column of gravel 14 is pre-placed adjacent completion zone 11 as described above. Well tool 17 is lowered on workstring 18 until it contacts the top of the pre-placed gravel 14. Workstring 18 is then rotated at the surface by a rotary table, power sub, or the like (none shown) to rotate auger-screen 20 and "auger" it downward into pre-placed gravel 14. Since the gravel being displaced by the auger-liner 20 as it moves downward is mechanically moved upward and outward along rotating auger blade 23, there is no need to "fluidize" the pre-placed gravel 14 by circulating fluid through the workstring 18 and up the annulus 28 formed between casing 13 and the workstring 18. Also, as the gravel is moved upward by auger blade 23, some of this gravel is likely to be forced into perforations 13*a* in casing 11 thereby improving the overall efficiency of the gravel pack 14. Further the "fish-tail" bit at the forward or leading edge of sub 24 easily penetrates the pre-placed gravel 14 and displaces the gravel onto auger blade 23 thereby allowing the auger-liner assembly to be augered into position without the circulation of fluid.

In gravel pack completions of this type wherein the liner is rotated into a column of pre-placed gravel, it is important to maintain the downhole wellbore pressure as close as is practical to the pressure in formation 12. That is, it is desirable to "balance" or preferably slighty "underbalance" the hydrostatic pressure in the well in relation to the formation pressure so that there will be no substantial excess pressure exerted onto the top of the pre-placed gravel column as the liner is being rotated into place. If there is too much excess pressure on the gravel column, it tends to compact the column and/or form a "crust" on the column which makes the rotation of the liner into the gravel very difficult, if possible at all.

Figure 2A:
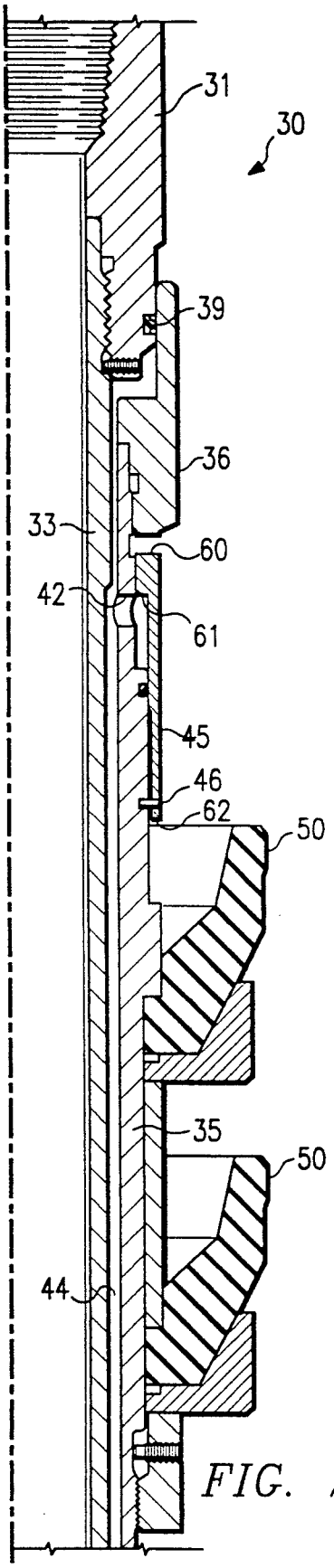
FIG. 2A is an enlarged sectional view of the upper portion of the packer cup and by-pass assembly of FIG. 1.
Figure 2B:
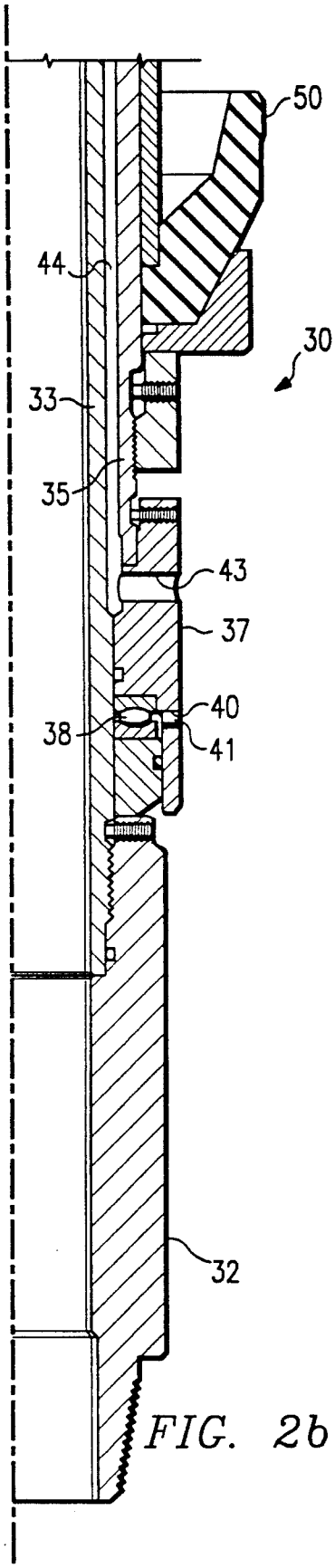
FIG. 2B is an enlarged sectional view of the lower portion of the packer cup and by-pass assembly of FIG. 1 and slightly overlaps FIG. 2A.

To prevent excessive hydrostatic pressure being exerted onto the gravel column 14, packer cup and by-pass assembly 30 is coupled into workstring 18 as shown in FIG. 1. Referring now to FIGS. 2A and 2B, packer cup and by-pass assembly 30 is comprised of an upper coupling 31 (FIG. 2A) and a lower coupling 32 (FIG. 2B) which are fixedly connected to the respective ends of a base pipe 33. As will be understood, couplings 31,32 are used to couple assembly 30 into workstring 18 wherein base pipe 33 will effectively form a portion of the center bore of workstring 18.

Sleeve 35 having upper and lower collars 36, 37, respectively affixed at its respective ends is positioned over base pipe 33 and is mounted for rotational movement with respect therewith by bearing 38 (FIG. 2B) or the like at its lower end. A seal 39 or the like is positioned between the surfaces of coupling 31 and collar 36 to prevent leakage of fluid between these two relative rotatable surfaces. Lower collar 38 has an opening 40 adjacent bearing 38 which normally closed by plug 41 through which the bearing can be packed with grease. Sleeve 35 is spaced from base pipe 33 to form an annular passage 44 which extends substantially the length of the sleeve. Sleeve 35 has an opening 42 therethrough near its upper end and lower collar 37 has an opening 43 therethrough both of which communicate with annular passage 44.

Sliding valve 45 is slidably mounted on sleeve 35 and is normally held in a closed position to block flow through opening 42 by shear pin 46 or the like. Also mounted on sleeve 35 is at least one cup packer 50 (two shown). Cup packer 50 is of the type formed from elastomers such as rubber and are extremely well known in the art to prevent flow in many well applications. Cup packers of this type are commercially available from several major manufacturers. As shown, cup packers 50 are mounted on sleeve 35 with their open ends facing upward. In this position, fluids can easily flow pass the packers in an upward direction but any downflow or pressure will tend to expand the packers outward to block flow and effectively isolate an upper high pressure zone of the wellbore from a lower lower pressure zone of the wellbore.

Again referring to a gravel pack completion carried out with gravel pack tool 17, the tool will be run into the well on workstring 18 until the liner assembly 20 contacts the top of gravel column 14. Well 10 is normally full of liquid which is required to balance the pressure of formation 12. After tool 17 comes to rest, the hydrostatic head of the liquid in the wellbore above cup packers 50 act on the cups to expand them outward thereby effectively isolating the gravel column 14 from the full blunt of the hydrostatic pressure above the cups which would otherwise be exerted onto the gravel column.

By effectively blocking off that portion of the liquid column above the packer cups, the pressure at the top of the gravel column will quickly equalize substantially with the formation pressure whereby the liner assembly can be easily rotated into the gravel column. Since packer cups 50 are mounted on sleeve 35 which, in turn, is rotatable with respect to base pipe 33, base pipe 33 (i.e. workstring 18) can be rotated while sleeve 35 while cups 50 are held relatively stationary by the friction of the expanded cups against casing 13.

After the liner is in place within gravel column 14, it is routine to set packer 29, if present, by running a tool down the workstring or in some other manner, and then releasing and removing the workstring 18. Since upward-facing packer cups 50 prevent downward flow of fluid, they present a problem in removing workstring 18. Since any reasonable rate of withdrawal will cause "swabbing" of the well, if not for the present invention, cups 50 would either have to be subjected to enough pressure to "turn them upside-down" or to rupture and destroy the cups. Neither of these alternatives are desirable.

In the present invention, packer cup and by-pass assembly 30 includes a by-pass, the structure of which has been described above. In operation, the hydrostatic forces in the well act upon basically three surfaces of sliding valve 45. Hydrostatic pressure above cups 50 act downward on relative large surface 60 (FIG. 2A) and upward on small surface 62. Pressure below cups 50 acts upward through opening 43 (FIG. 2B), passage 44, opening 42 (FIG. 2A) onto surface 61 of valve 45. The upward acting forces on surfaces 61, 62 effectively counterbalance the downwardly acting force on surface 60.

To insure that the valve 45 will remain in a closed position during installation, shear pin(s) 46 are used to releasably latch the valve to the sleeve and are sized to shear under a predetermined load on surface 60. Accordingly, when it is desired to come out the hole with workstring 18, the pressure in the well annulus above the cups 50 is increased from the surface to a value which will shear pin(s) 46. When this occurs, the pressure on surface 60 of valve 45 moves it downward to an open position thereby allowing flow to by-pass cups 50 through opening 42, passage 44, and out opening 43. This allows workstring 18 to be easily withdrawn from the well without damaging cups 50. Workstring 18 is routinely replaced with a production tubing or the like (not shown) to complete the well completion as will be understood by those skilled in the art.

Figure 3:
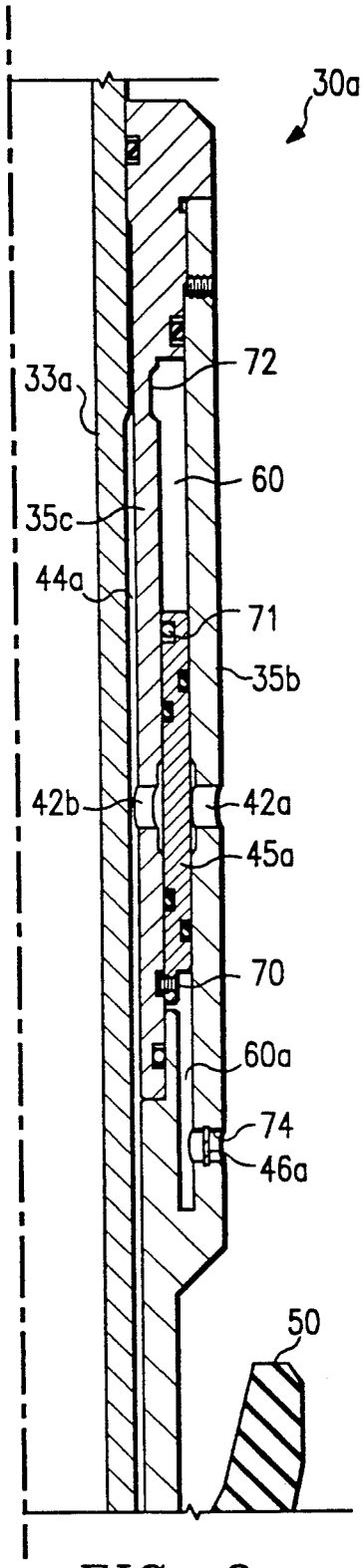
FIG. 3 is an enlarged sectional view of another embodiment of the upper section of the packer cup and by-pass assembly.

Pin(s) 45 in the packer cup and by-pass assembly 30 as shown in FIGS. 2A and 2B are designed to shear in response to a set differential pressure. That is, when the pressure at surface 60 exceeds the sum of the pressures at surfaces 61 and 62 plus the strength force of the pin(s), the pin(s) will shear and the valve will be moved to an open position by the pressure in the well. This may occur either when the well pressure is deliberately increased as described above or it may occur automatically if the pressure below the cups 50 drops below an anticipated value, thereby creating an unexpected differential pressure sufficient to shear pin(s) 45. FIG. 3 illustrates an embodiment 30*a* of the present packer cup and by-pass assembly which can not be accidentally opened by such a unexpected drop in the formation pressure.

Referring now to FIG. 3, the upper portion of assembly 30*a* is illustrated. The lower portion of assembly 30*a* is the same as that shown in FIG. 2B. Assembly 30*a* is comprised of a sleeve 35*a* which is rotatably mounted on and spaced from base pipe 33*a* to form an annular passage 44*a* therebetween which, in turn, extends substantially the length of the sleeve. Sleeve 35 has an outer element 35*b* and an inner element 35*c* which together form a chamber 60 therebetween and which have aligned openings 42*a* and 42*b*, respectively, therein. Valve 45*a* is slidably positioned within chamber 60 and is normally held in its closed position (FIG. 3) by shear pin 70 or the like to block flow through openings 42*a*, 42*b*. Also, outer element 35*b* has a radial opening therethrough which, in turn, is normally closed by a pressure-sensitive valve, e.g. rupture disk 46*a*.

In operation, the assembly 30*a* is assembled into gravel pack well tool 17 which, in turn, is lowered into a well and installed in the same manner as described above. The pressure in chamber 60*a*, i.e. below valve 45*a* will remain substantially at atmospheric pressure during the installation of gravel pack tool 17. When it is desirable to come out of the hole, the pressure in the wellbore above cups 50 is increased from the surface as before to a value necessary to rupture or otherwise open pressure-sensitive valve 46*a*. Once opening 74 is opened, pressure acts on the lower surface of valve 45*a* to shear pin(s) 70 and move the valve upward to an open position. Snap-ring 71 expands upon passing shoulder 72 to engage same to hold the valve in an open position. Fluid is now free to flow from below cups 50 to the well annulus above the cups through the by-pass provided by opening 43 (FIG. 2B), passage 44, and openings 42*a*, 42*b*.

While the present gravel pack tool has been described as having upward-facing cup packers, it should be recognized that there may be instances where it is desirable to prevent upward flow during a gravel pack installation; i.e. prevent flow out of the formation without using expensive heavily-weighted liquids and to prevent gas migration to the surface. In such cases, the present packer cup and by-pass assembly is merely adapted to be put into a workstring "upside down". The center bore of workstring 18 is open to flow as the assembly is lowered so the well fluids will flow up the bore and thereby bypass the downwardly-facing packer cups as the workstring is lowered. Once the liner in position at the top of the gravel column, if the pressure below the cups is greater than above, the differential pressure will act on the cups to expand them and prevent upward flow. It will not be necessary to provided a by-pass valve or to actuate the by-pass valve, if present, to come out of the hole since the fluid above the cups can easily flow by the downward-facing cups. Likewise, both upward and downward-facing packer cups can be provided in a workstring if a particular situation so dictates.

What is claimed is:

1. A packer cup and by-pass assembly for a workstring of the type used for carrying out an operation in a well, said assembly comprising:

a base pipe adapted to be coupled into said workstring;

a sleeve rotatably mounted on said base pipe; and at least one cup packer mounted on said sleeve whereby said base pipe can freely rotate with respect to said cup packer when said at least one cup packer is expanded.

2. The assembly of claim 1 wherein said at least one cup packer is positioned on said sleeve to face upward to prevent downward flow when said workstring is in an operable position within a well.

3. The assembly of claim 1 wherein said at least one cup packer is positioned on said sleeve to face downward to prevent upward flow when said workstring is in an operable position within a well.

4. The assembly of claim 2 including:

a valve normally in a closed position including means for blocking flow by said at least one cup packer and means responsive to an increase in pressure for opening said valve to allow bypass of fluid past said at least one cup packer.

5. A packer cup and by-pass assembly for a workstring of the type used for carrying out an operation in a well, said assembly comprising:

a base pipe adapted to be coupled into said workstring;

a sleeve rotatably mounted on said base pipe, at least one cup packer mounted on said sleeve whereby said base pipe can freely rotate with respect to said cup packer when said at least one cup packer is expanded, said at least one cup packer being positioned on said sleeve to face upward to prevent downward flow when said workstring is in an operable position within a well;

said sleeve forming a passage between said sleeve and said base pipe which extends along said base pipe from a point above said cup packer to a point below said cup packer; and a valve which blocks flow through said passage when in a closed position and allows flow through said passage when in an open position.

6. The assembly of claim 5 wherein said passage includes an opening in said sleeve above and below said cup packer and wherein said valve comprises:

a sliding valve mounted on said sleeve to block said opening through said sleeve above said cup packer;

means for holding said valve in a closed position until subjected to a predetermine fluid pressure.

7. The assembly of claim 6 wherein said means for holding said valve in a closed position comprises:

at least one shear pin.

8. The assembly of claim 5 wherein said sleeve includes a chamber and said passage includes an opening in said sleeve above and below said cup packer and wherein said valve comprises:

a sliding valve mounted in said chamber to block said opening through said sleeve above said cup packer;

means for holding said valve in a closed position until subjected to a predetermined pressure.

9. The assembly of claim 8 wherein said means for holding said valve in a closed position comprises:

an opening through said sleeve adjacent one end of said sliding valve; and a pressure-sensitive valve closing said opening adjacent said sleeve, said valve being responsive to a predetermined pressure to open said opening to flow.

10. The assembly of claim 9 wherein said pressure-sensitive valve comprises:

a rupture disk.

11. A gravel pack completion tool for use in installing a gravel pack completion in a well, said tool comprising:

a workstring;

a permeable liner connected to said workstring, said liner adapted to be rotated into a column of gravel pre-placed in said well, said liner comprising a fluid-permeable body and an auger blade secured to and extending around said body; and a packer cup and by-pass assembly in said workstring for preventing downward flow in the well while said liner is rotated into said pre-placed gravel.

12. The completion tool of claim 11 including;

a fish-tail bit connected to one end of said liner.

13. The completion tool of claim 12 wherein said packer cup and by-pass assembly comprises:

a base pipe adapted to be coupled into said workstring;

a sleeve rotatably mounted on said base pipe; and at least one cup packer mounted on said sleeve whereby said base pipe can freely rotate with respect to said cup packer when said at least one cup packer is expanded.

14. The assembly of claim 13 wherein said at least one cup packer is positioned on said sleeve to face upward to prevent downward flow when said workstring is in an operable position within a well.

15. The assembly of claim 13 wherein said at least one cup packer is positioned on said sleeve to face downward to prevent upward flow when said workstring is in an operable position within a well.

16. The assembly of claim 14 including:

a valve normally in a closed position to block flow by said at least one cup packer and responsive to an increase in pressure to open to allow bypass of fluid pass said at least one cup packer.

* * * * *